United States Patent [19]

Graf

[11] Patent Number: 4,580,434

[45] Date of Patent: Apr. 8, 1986

[54] DEFLECTION COMPENSATING ASSEMBLY FOR A PRESS BRAKE

[75] Inventor: Raymond J. Graf, Cincinnati, Ohio

[73] Assignee: Cincinnati Incorporated, Cincinnati, Ohio

[21] Appl. No.: 551,165

[22] Filed: Nov. 14, 1983

[51] Int. Cl.[4] ..... B21D 5/02

[52] U.S. Cl. ..... 72/389; 72/465; 100/258 R

[58] Field of Search ..... 72/389, 461, 386, 465; 100/269 R, 258 R, 258 A

[56] References Cited

U.S. PATENT DOCUMENTS

| | | | |
|---|---|---|---|
| 3,550,425 | 12/1970 | Cailloux | 100/258 A |
| 3,914,975 | 10/1975 | Kawano | 72/389 |
| 4,016,742 | 4/1977 | Shiokawa | 72/389 |
| 4,098,109 | 7/1978 | Cailloux | 72/389 |

FOREIGN PATENT DOCUMENTS

| | | | |
|---|---|---|---|
| 612808 | 1/1961 | Canada | 72/389 |
| 1527979 | 11/1971 | Fed. Rep. of Germany | 72/389 |

*Primary Examiner*—Francis S. Husar
*Assistant Examiner*—David B. Jones
*Attorney, Agent, or Firm*—Frost & Jacobs

[57] ABSTRACT

A deflection compensating cylinder and auxiliary cross-member assembly, for use with a press brake of the type having a bed, a ram, and a pair of main cylinders actuating the ram. The assembly causes the die-supporting edges of the bed and ram to remain substantially parallel under load. A pair of auxiliary cross-members are located to each side of the bed, extending the majority of the length thereof. The cross-members are affixed to the bed by a pair of pins, each located near an end of the cross-members and extending therethrough and through the bed. The cross-members have corresponding, coextensive, longitudinal slots formed therein and located centrally thereof. The bed contains a similar slot, slightly offset in a vertical direction with respect to the cross-member slots. A deflection compensating cylinder is mounted in the cross-member and bed slots with the cylinder contacting one of the bed and cross-members and its piston contacting the other of the bed and cross-members. The compensating cylinder has a working area four times that of one of the main cylinders. The compensating cylinder is connected to the same hydraulic source as the main cylinders and is subject to the same pressure so that when the bed and ram are under load against a workpiece, the compensating cylinder will remove the downward deflection from the bed and impart thereto an upward deflection substantially similar to that of the ram. The deflection compensating assembly could be mounted on the ram, instead of the bed, to accomplish the same results.

5 Claims, 19 Drawing Figures

DEFLECTION COMPENSATING ASSEMBLY FOR A PRESS BRAKE

TECHNICAL FIELD

The invention relates to a deflection compensating assembly for a press brake, and more particularly to a deflection compensating cylinder and a pair of auxiliary cross-members mountable on the press brake bed or ram, to cause the die-supporting edges of the bed and ram to remain substantially parallel under the load.

BACKGROUND ART

The present invention is directed to hydraulically actuated press brakes. In its most usual form, a hydraulically actuated press brake comprises a stationary bed, a ram mounted above the bed and capable of reciprocating movement toward and away from the bed in a vertical direction, a pair of substantially identical main cylinders operatively connected to the ends of the ram to shift the ram toward and away from the bed, and a source of hydraulic fluid under pressure to actuate the main cylinders. Deflection of the press brake bed and ram when under load against a workpiece constitutes a problem which has plagued the industry from its beginning to the present day. Such deflection of the press brake bed and ram causes their cooperating tool or die-carrying edges to go out of parallelism during the work stroke.

The nature of this problem can most easily be explained by selecting, for example, one of the most common forms of press brake work, i.e., the air bending of a flat piece of metal into an angle. In the most usual instance of such an operation, the top or male die is mounted on the lower edge of the ram. When the ram moves downwardly, the top or male die pushes the workpiece into a lower or female die, mounted on the upper edge of the stationary bed. The inherent problem of bed and ram deflection, occurring as the result of bending load, results in a variation in the bend angle along the length of the bend in the workpiece.

Prior art workers have made numerous attempts to overcome this problem. A common practice is to shim one of the dies (usually the female die), or the filler block thereunder, so that the dies are parallel in the loaded condition. This solution is effective but less than ideal. It is a trial-and-error process and hence very time consuming. In today's factory, the trend to small lot sizes, makes this solution unacceptable.

Another approach has been to crown the tool or die carrying edges of the bed and ram, so that these edges are purposely not parallel in the unloaded condition. They are closer together in the center than at the ends. The amount of this crown is carefully controlled so that the bed and ram are deflected to a parallel position when subjected to a load equal to some predetermined fraction (say $\frac{2}{3}$) of the machine's capacity distributed uniformily over the nominal length. In bending operations wherein the load is equal to (or substantially equal to) this predetermined fraction of the machine's capacity, the male die penetration into the female die is constant and the bend angle is uniform along its length. For bending operations which depart from these predetermined conditions, this solution does not work well.

The present invention is based upon the discovery of means which may be applied to the bed or the ram to give the bed or ram a variable, proportional crown which will automatically compensate for both bed and ram deflection for an applied load of any magnitude and length. The structure of the present invention causes the bed and ram tool or die-carrying edges to remain substantially parallel in the loaded condition, as will be described hereinafter.

DISCLOSURE OF THE INVENTION

According to the invention there is provided a deflection-compensating cylinder and auxiliary cross-member assembly for use with a press brake of the type having a bed, a ram, and a pair of main cylinders actuating the ram.

A pair of plate-like auxiliary cross-members are located to each side of the bed. The cross-members extend horizontally and longitudinally of the bed for the majority of its length. The cross-members are affixed to the bed by a pair of pins. Each pin is located near an end of the cross-members and extends through the cross-members and the bed.

The cross-members have corresponding, coextensive slots formed therein. These slots are located centrally of the cross-members and extend longitudinally thereof. The bed contains a similar slot which is offset in a vertical direction with respect to the cross-member slots.

A deflection compensating cylinder-piston assembly is mounted in the cross-member and bed slots in such a way that the cylinder abuts either the bed or the cross-members, while the cylinder piston abuts the other of the bed or cross-members. The compensating cylinder has a working area four times that of one of the main cylinders and is connected to the same hydraulic source so that the main cylinders and the compensating cylinder are subject to the same hydraulic pressure.

When the bed and the ram are under load against a workpiece, the compensating cylinder will push upwardly against the bed and downwardly on the auxiliary cross-members, these forces being reacted at the pin connections. Since the compensating cylinder has an area four times that of one of the main cylinders (or twice that of both main cylinders), the compensating cylinder will not only eliminate the normal downward deflection of the bed, but also will deflect the bed upwardly by an amount equal in magnitude to the defection of the ram. The net result is that the tool or die carrying edges of the bed and ram remain substantially parallel, and the male die penetration (and hence the bend angle) is substantially constant along the length of the workpiece.

BRIEF DESCRIPTION OF THE INVENTION

While hydraulically actuated press brakes are capable of many operations, the nature of the problem sought to be overcome and the nature of the present invention will be described, for purposes of an exemplary showing, with respect to the simple operation of air bending a flat piece of metal into an angle.

Figure 1:
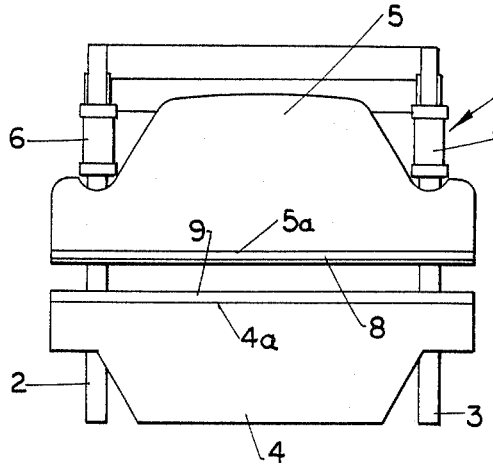
FIG. 1 is a semi-diagrammatic, front elevational view of a typical press brake wherein the tool or die-supporting edges of the bed and ram are normally parallel to each other.

Referring first to FIG. 1, a conventional press brake is generally indicated at 1. The press brake comprises a pair of side frames 2 and 3 on which is supported a stationary bed 4. A ram 5 is also operatively supported on side frames 2 and 3 for reciprocating movement toward and away from the bed 4. The ram 5 is actuated by a pair of substantially identical hydraulic cylinders 6 and 7, themselves supported by side frames 2 and 3. The cylinders 6 and 7 are connected to a hydraulic fluid reservoir and pump arrangement, well known in the art and not a part of the present invention. The press brake 1 will also be provided with conventional controls (not shown).

In the most usual arrangement, a top die 8 is affixed to the die-supporting edge 5*a* of the ram and a cooperating lower die 9 is affixed to the die-supporting edge 4*a* of stationary bed 4. While not always the case, the top die 8 is generally a male die and the lower die 9 is usually a cooperating female die. The nature of the dies or tools carried by the ram 5 and bed 4 do not constitute a limitation on the present invention.

It is a problem, inherent in such press brakes, that when the bed 4 and ram 5 are under load against a workpiece, they will be subject to deflection. Many tons of force are involved, and for most operations, no matter how large and sturdy the bed 4 and ram 5, deflection thereof will occur.

Figure 2:
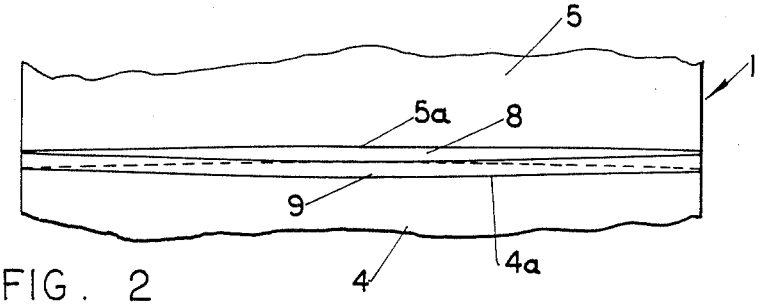
FIG. 2 is a fragmentary, semi-diagrammatic, enlarged elevational view of the bed and ram of the press brake of FIG. 1, illustrating in exaggerated form the deflections thereof under load.
Figure 3:
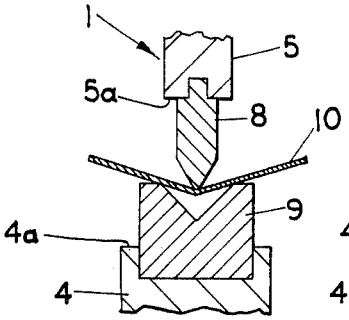
FIGS. 3 and 4 are fragmentary, semi-diagrammatic, cross sectional views illustrating (in exaggerated form) the relative positions under load of the bed and ram of FIGS. 1 and 2, their dies and the resulting bend in the workpiece, at the center of the workpiece and near an end of the workpiece, respectively.
Figure 4:
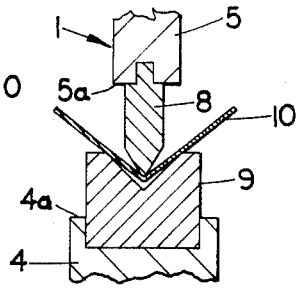
Figure 5:
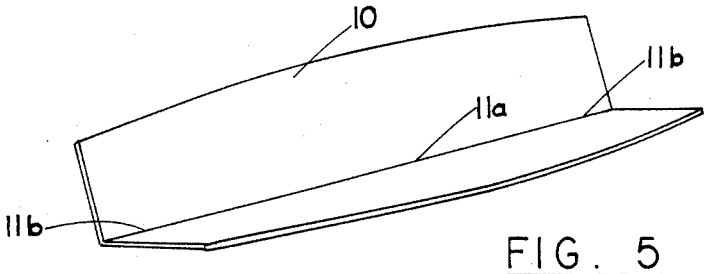
FIG. 5 is perspective view illustrating, in exaggerated form, the fully bent workpiece of FIGS. 3 and 4.

If the tool or die-supporting edges 4*a* of the bed and 5*a* of the ram are parallel in the unloaded condition, they will be, under load, deflected away from each other to a non-parallel condition as shown, in exaggerated form, in FIG. 2. Because of this deflection, the male die 8 does not enter the female die 9 as far at the middle of the bend in the workpiece than it does at the ends of the bend in the workpiece. In FIG. 2, the workpiece is not shown for purposes of clarity. A workpiece 10 is shown, however, in FIGS. 3 and 4. FIG. 3 illustrates, in exaggerated form, the amount of penetration of the male die 8 into the female die 9 at the center 11*a* of the bend in workpiece 10 (i.e., at the longitudinal center of the workpiece). FIG. 4 illustrates, in exaggerated form, the amount of penetration of the male die 8 into the female die 9 near an end 11*b* of the bend in the workpiece 10 (i.e., near one end of the workpiece). This yields what is often termed a "canoe-shaped" or "barrel-shaped" workpiece, as shown in FIG. 5. The amount of angular variation is a function of the length of the bend and the percentage of available tonnage used. On short bends, it is very small (typically 0.1° on a 2-foot long bend). On long bends, the angular variation can be become very significant (approximately 4° on a 10-foot bend). Table I below gives the theoretical calculated bend angle variation for mild steel samples for 90° bends of various lengths and thicknesses when using a typical 135-ton press brake, similar to the one shown in FIG. 1, having a 10-foot nominal length bed with the die-supporting bed and ram edges being parallel.

TABLE I

| Mild Steel Thickness | Nominal V-Die Opening | Bend Angle Variation in Degrees for Given Workpiece Lengths | | | | |
|---|---|---|---|---|---|---|
| | | 2' | 4' | 6' | 8' | 10' |
| 20 Ga. | .312 | 0.1 | 0.4 | 1.2 | 2.4 | 4.0 |
| 18 Ga. | .375 | 0.1 | 0.5 | 1.3 | 2.6 | 4.4 |
| 16 Ga. | .500 | 0.1 | 0.5 | 1.3 | 2.5 | 4.1 |
| 14 Ga. | .625 | 0.1 | 0.5 | 1.3 | 2.5 | 4.1 |
| 12 Ga. | .875 | 0.1 | 0.5 | 1.2 | 2.4 | 4.1 |
| 11 Ga. | 1.000 | 0.1 | 0.5 | 1.3 | 2.5 | 4.1 |
| 10 Ga. | 1.250 | 0.1 | 0.4 | 1.0 | 1.9 | 3.2 |
| 3/16" | 1.500 | 0.1 | 0.5 | 1.3 | 2.4 | 4.1 |
| ¼" | 2.000 | 0.1 | 0.5 | 1.3 | 2.5 | — |
| 5/16" | 2.500 | 0.1 | 0.5 | 1.3 | — | — |
| ⅜" | 3.000 | 0.1 | 0.5 | — | — | — |
| 7/16" | 3.500 | 0.1 | 0.5 | — | — | — |
| ½" | 5.000 | 0.1 | 0.3 | — | — | — |

All bends are more obtuse at the center than at the ends. The theoretical bend variations of Table I are due to ram and bed deflection only. The values in Table I do not include any variations resulting from repeatability, level errors, or from inaccuracies in the tooling.

As indicated above, the most usual prior art practice to overcome this problem has been to shim one of the dies (usually the female die 9) so that dies 8 and 9 are parallel in loaded condition. The fact that this is a trial-and-error process and is time consuming renders this solution less than ideal.

Figure 6:
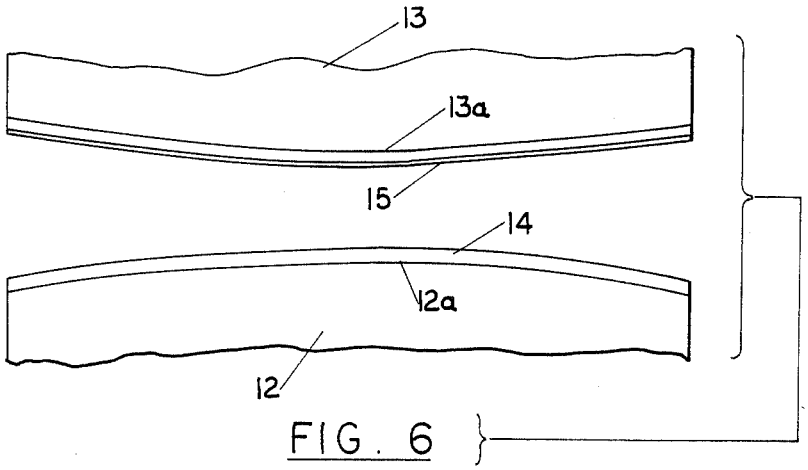
FIG. 6 is a fragmentary, semi-diagrammatic view of a bed and ram, similar to FIG. 2, and illustrating, in exaggerated form, a predetermined crown in the bed and ram.

Another prior art expedient is illustrated, in exaggerated form, in FIG. 6. In FIG. 6, a bed 12 is fragmentarily shown, together with a ram 13. The bed 12 has a tool or die-supporting edge 12*a* and is shown supporting a female die 14. The ram 13 has a tool or die-supporting edge 13*a* and is illustrated as having a male die 15 mounted thereon.

The bed 12 and ram 13 of FIG. 6 are illustrated in their open, unloaded condition. It will be noted that the tool or die-supporting edges 12*a* and 13*a* are crowned so that they are closer together at their centers than at their ends. It is again to be emphasized that FIG. 6 greatly exaggerates the amount of crown. The amount of crown is carefully controlled so that the ram and bed are deflected to a parallel position when subjected to a load equal to some predetermined fraction (for example, $\frac{2}{3}$) of the press brake's capacity, distributed uniformly over the nominal length. Under this applied load condition, the male die penetration is constant within the female die, and the bend angle is uniform along its length. As the load condition departs from the ideal upon which the crowning of bed 12 and ram 13 was based, the angular variation along the bend increases.

Figure 7:
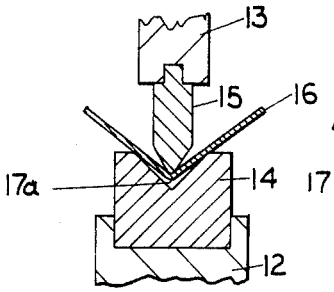
FIGS. 7 and 8 are fragmentary, semi-diagrammatic views, similar to FIGS. 3 and 4, illustrating the relative positions of the bed and ram and their respective dies, together with the bend in the workpiece (at the longitudinal center of the workpiece and near one end thereof, respectively) when the applied load condition does not match the crown conditions.
Figure 8:
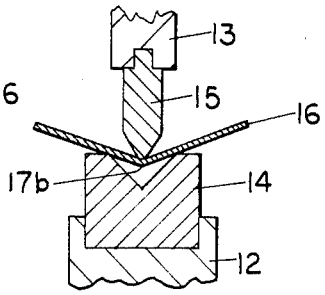
Figure 9:
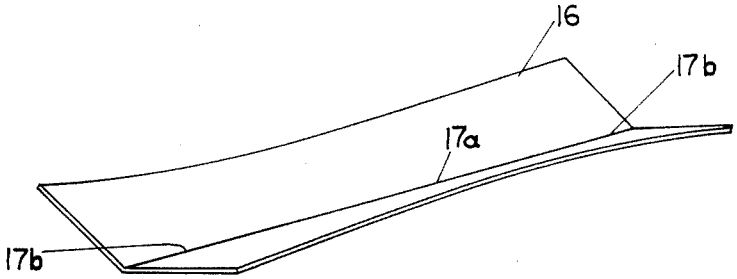
FIG. 9 is a perspective view illustrating the workpiece of FIGS. 7 and 8.

For example, in the instance of a long bend in thin material, where the bending load is much smaller than that required to remove the crown from the bed 12 and ram 13, the penetration of the male die 15 within female die 14 will be greater at the center of the bend than near its ends. FIG. 7 shows, in exaggerated form, the penetration of the male die 15 within female die 14 at the center 17*a* of the bend in workpiece 16. In a similar fashion, FIG. 8 illustrates, in exaggerated form, the penetration of the male die 15 within the female die 14 near one of the ends 17*b* of the bend in workpiece 16. Since the workpiece 16 is bent to a greater extent at its longitudinal center than near its ends, it will take on what is frequently termed a "hour-glass" shape as shown in FIG. 9. Again, the bend angle variation can be very large (as much as 10° in a 10-foot long bend in 20-gauge material on a typical 135-ton by 10-foot press brake having a 10-foot nominal length bed). This problem can be overcome by appropriately shimming the dies 14 and 15, but the problem with this sort of solution is the same as mentioned above with respect to shimming normally parallel dies. Table II below gives the theoretically calculated bend angle variation for mild steel samples for 90° bends of various thicknesses and lengths when using a typical 135-ton press brake of the type shown in FIG. 6 and having a 10-foot nominal length bed. Those values with a minus sign indicate bends open in the center.

TABLE II

| Mild Steel Thickness | Nominal V-Die Opening | Bend Angle Variation in Degrees for Given Workpiece Lengths | | | | |
|---|---|---|---|---|---|---|
| | | 2′ | 4′ | 6′ | 8′ | 10′ |
| 20 Ga. | .312 | 0.5 | 1.8 | 3.7 | 6.4 | 9.8 |
| 18 Ga. | .375 | 0.4 | 1.4 | 2.8 | 4.8 | 7.1 |
| 16 Ga. | .500 | 0.3 | 0.9 | 1.8 | 3.0 | 4.5 |
| 14 Ga. | .625 | 0.2 | 0.7 | 1.2 | 2.0 | 2.8 |
| 12 Ga. | .875 | 0.1 | 0.3 | 0.5 | 0.7 | 0.9 |
| 11 Ga. | 1.000 | 0.1 | 0.2 | 0.3 | 0.3 | 0.2 |
| 10 Ga. | 1.250 | 0.1 | 0.2 | 0.3 | 0.3 | 0.3 |
| 3116″ | 1.500 | 0 | 0 | −0.2 | −0.6 | 1.2 |
| ¼″ | 2.000 | 0 | −0.1 | −0.5 | −1.1 | — |
| 5/16″ | 2.500 | 0 | −0.2 | −0.7 | — | — |
| ⅜″ | 3.000 | 0 | −0.3 | — | — | — |

TABLE II-continued

| Mild Steel Thickness | Nominal V-Die Opening | Bend Angle Variation in Degrees for Given Workpiece Lengths | | | | |
|---|---|---|---|---|---|---|
| | | 2′ | 4′ | 6′ | 8′ | 10′ |
| 7/16″ | 3.500 | 0 | −0.3 | — | — | — |
| ½″ | 5.000 | 0 | −0.2 | — | — | — |

Those values preceded by "−" are bends more obtuse at the center than at the ends. The values of Table II are due to ram and bed deflection only and do not take into account variations due to repeatability, level errors or from inaccuracies in the tooling.

The present invention provides a bed with a variable, proportional crown which automatically compensates for both bed and ram deflection for an applied load of any magnitude and length, causing the bed and ram tool or die-supporting edges to remain parallel in the loaded condition.

Reference is now made to FIGS. 10–14, wherein like parts have been given like index numerals. In these Figures, a conventional press brake bed is shown at 18. A pair of substantially identical, plate-like auxiliary cross-members 19 and 20 are located to either side of bed 18. It will be noted from FIG. 10 that the cross-member 19 extends horizontally and longitudinally of bed 18, for the majority of its length. The same is true of cross-member 20. Each cross-member 19 and 20 has a thickness about one-half the thickness of the bed 18.

Figures 10, 11, 12, 13, 14:
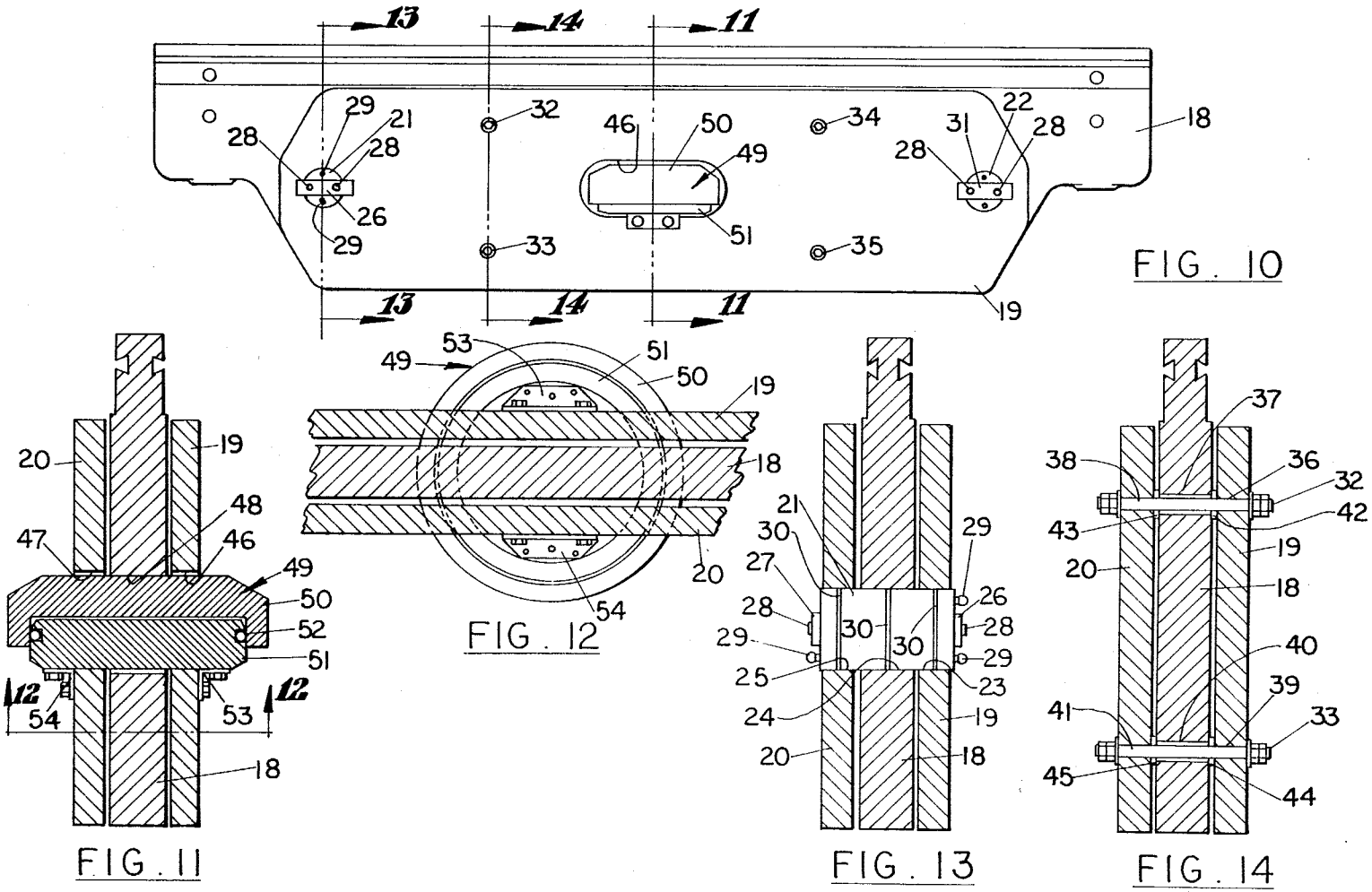
FIG. 10 is an elevational view of a bed provided with the compensating assembly of the present invention.
FIG. 11 is a cross-sectional view taken along section line 11—11 of FIG. 10.
FIG. 12 is a fragmentary cross-sectional view taken along section 12—12 of FIG. 11.
FIG. 13 is a cross-sectional view taken along section line 13—13 of FIG. 10.
FIG. 14 is a cross-sectional view taken along section line 14—14 of FIG. 10.

Cross-members 19 and 20 are affixed to bed 18 near their ends by pins 21 and 22. Pin 21 is most clearly shown in FIG. 13. Pin 21 extends through coaxial perforations 23, 24 and 25 located in cross-member 19, bed 18 and cross-member 20, respectively. A pair of plates 26 and 27 are mounted on the end faces of pin 21 by screws 28. The plates 26 and 27 are of a length greater than the diameter of pin 21 so that they overlap the adjacent faces of cross-members 19 and 20, respectively. In this way, the plates 26 and 27 prevent axial shifting of pin 21. Pin 21 may additionally be provided with conventional grease fittings 29 and lubricating grooves 30. It will be understood that pin 22 is identical to pin 21 and is mounted in an identical manner, provided with transversely extending plates 26 and 27, one of which is shown in FIG. 10 at 31. Pins 21 and 22 permit relative movement between bed 18 and cross-members 19 and 20. The assembly may additionally be held together by two pairs of bolts 32–33 and 34–35. The pair of bolts 32 and 33 are illustrated in FIG. 14. Bolt 32 passes through perforations 36 in cross-member 19, 37 in bed 18 and 38 in cross-member 20. Similarly, bolt 33 passes through perforation 39 in cross-member 19, perforation 40 in bed 18, and perforation 41 in cross-member 20. In addition, bolt 32 may carry steel washer-like spacers 42 and 43, located respectively between bed 18 and cross-member 19, and bed 18 and cross-member 20. Bolt 33 will be provided with similar steel washer-like spacers 44 and 45. It will be noted that the perforations 37 and 40 in the bed 18 are of enlarged diameter so as to permit relative movement in the vertical directions between the bed 18 and the cross-members 19 and 20. It will be understood that the pair of bolts 34 and 35 are identical to the pair of bolts 32 and 33 and are identically arranged in the bed 18 and cross-members 19 and 20.

Reference is now made to FIGS. 10, 11 and 12, and particularly to FIG. 11. The cross-member 19 is provided with a longitudinally extending, horizontal slot 46

(see also FIG. 10). The cross-member 20 is provided with an identical and coextensive slot 47. The bed 18 is provided with a similar longitudinal slot 48. It will be noted from FIG. 11, however, that the bed slot 48 is offset slightly downwardly with respect to the cross-member slots 46 and 47.

Mounted within the slots 46, 47 and 48, there is a hydraulic cylinder and piston assembly generally indicated at 49. The hydraulic assembly 49 comprises cylinder 50, piston 51, with a piston seal 52 therebetween. The assembly 49 is prevented from lateral movement by a pair of brackets 53 and 54 affixed to cross-members 19 and 20, respectively, and both affixed to piston 51.

In all of FIGS. 10–14, the various parts are shown in their normal, at rest positions. As is most clearly shown in FIG. 11, due to the offset of slot 48 with respect to slots 46 and 47, the cylinder 50 is in abutment with bed 18 and out of contact with cross-members 19 and 20. At the same time, the piston 51 is in abutment with cross-members 19 and 20, and is spaced from bed 18. As can be appreciated from FIG. 10, the hydraulic cylinder-piston assembly 49 is located at the vertical center lines of bed 18 and cross-members 19 and 20. Furthermore, the center line of cylinder action and the axes of pins 21 and 22 lie on the longitudinal center lines of cross-members 19 and 20.

Figure 15:
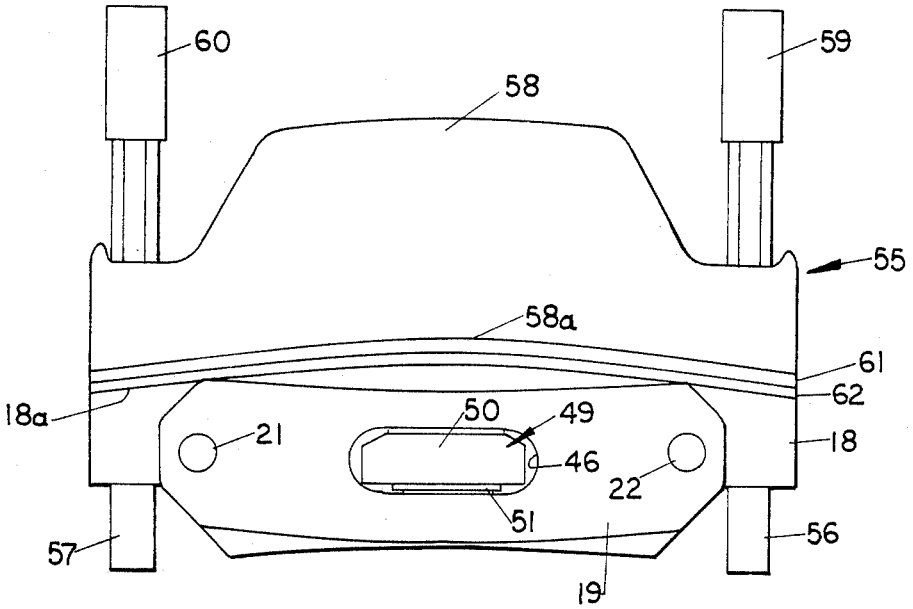
FIG. 15 is a semi-diagrammatic elevational view of a conventional hydraulic press brake, the bed of which is provided with the compensating assembly of the present invention, and illustrating, in exaggerated form, the resulting deflections of the ram and bed.

Reference is now made to FIG. 15. FIG. 15 is a semi-diagrammatic representation of a hydraulic press brake, generally indicated at 55, and provided with the bed assembly of FIGS. 10–14. The bed 18 is mounted on side frames 56 and 57. The press brake 55 is provided with a ram 58 actuated by main cylinders 59 and 60. The ram is provided with a male die 61, while the bed 18 is provided with a female die 62. In FIG. 5, the ram 58 is shown closed against the bed, a workpiece having been eliminated from FIG. 15 for purposes of clarity. In any event, the ram 58 and bed 18 are to be considered as under load.

The hydraulic cylinder-piston assembly 49 is connected to the same hydraulic fluid source and pump (not shown) as are main cylinders 59 and 60. As a result, the cylinder-piston assembly 49 will be subjected to the same hydraulic pressure as main cylinders 59 and 60. The cylinder-piston assembly 49 has a piston working area four times that of main cylinder 59 or main cylinder 60. Thus, the working area of assembly 49 is equal to twice the working areas of main cylinders 59 and 60, combined.

The operation of the present invention may be described as follows. When the press brake 55 is provided with the bed 18 and compensating means of the present invention, the tool or die-supporting edges 58*a* and 18*a* of the ram 58 and bed 18 will normally be parallel when not under load, in a manner similar to that described with respect to FIG. 1. When the ram 58 descends and its male die 61 bends the workpiece into the female die 62 of bed 18, the ram 58 and bed 18 will be under load. The ram 58 will be deflected upwardly, as described with respect to ram 5 in FIG. 2. Without the compensating assembly of the present invention, the bed 18 would be deflected downwardly, as described with respect to bed 4 of FIG. 2. However, the cylinder-piston assembly 49 is subject to the same hydraulic pressure as main cylinder 59 or main cylinder 60, and its working area is twice that of main cylinder 59 and main cylinder 60, together. The force developed by main cylinders 59 and 60 is equal to the forming load, and the force generated by the cylinder-piston assembly 49 is proportional to the forming load. The cylinder 50 pushes upwardly on bed 18 at its center and piston 51 pushes downwardly on the centers of cross-members 19 and 20. These forces are reacted at pins 21 and 22. The relationship of the cylinder-piston assembly 49 to the main cylinders 59 and 60 is such that deflection of bed 18, resulting from the combination of the downwardly acting applied load and the upwardly acting load from cylinder 50, is an upward deflection equal in magnitude to the deflection of the ram. The net result is the tool or die-supporting edges of the bed and ram remain essentially parallel, and the penetration of the male die 61 into female die 62 (and hence the bend angle) is substantially constant along the length of the workpiece.

Figure 16:
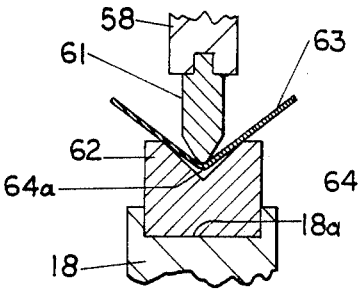
FIGS. 16 and 17 are fragmentary, cross-sectional views, similar to FIGS. 3 and 4 and FIGS. 7 and 8, illustrating the relative positions of the bed and ram, their dies and the resulting bend in the workpiece at the center and at the end of the workpiece, respectively.
Figure 17:
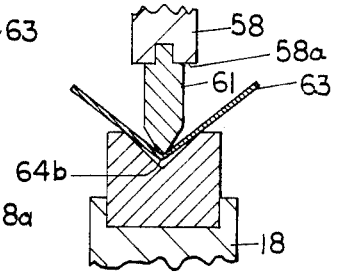
Figure 18:
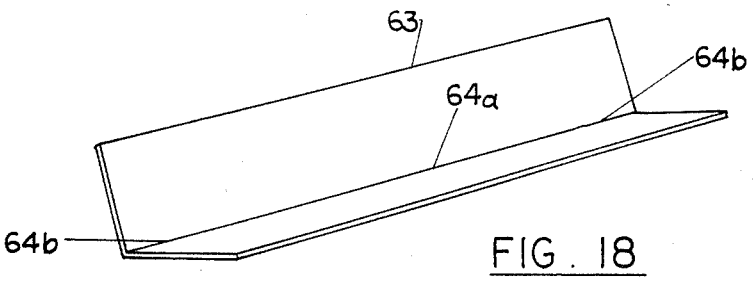
FIG. 18 is a perspective view illustrating the fully bent workpiece of FIGS. 16 and 17.

FIG. 16 is a fragmentary cross-sectional view taken at the longitudinal center of a workpiece. FIG. 17 is a cross-sectional view, similar to FIG. 16, but taken near one of the ends of workpiece 63. The bend angle at 64*a* in FIG. 16 is substantially identical to the bend angle at 64*b* in FIG. 17. FIG. 18 is a perspective view of workpiece 63 having a substantially uniform bend angle throughout its length.

It should be noted that the deflected shape of bed 18 does not precisely match the deflected shape of the ram 58. This is because the concentrated load applied by cylinder-piston assembly 49 on bed 18 does not deflect the bed 18 in exactly the same manner as the uniformly distributed load applied by the workpiece on ram 58. However, the deflected shapes of ram 58 and bed 18 are sufficiently close that the resulting bend angle variation is not significant.

Figure 19:
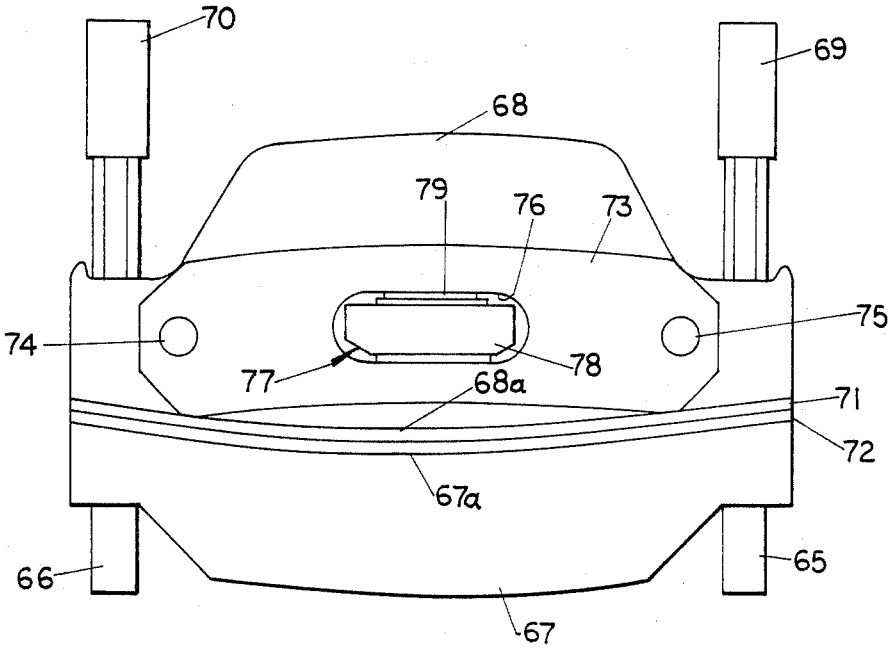
FIG. 19 is a semi-diagrammatic elevational view of a conventional hydraulic press brake, the ram of which is provided with the compensating assembly of the present invention, and illustrating, in exaggerated form, the resulting deflections of the ram and bed.

It will be understood by one skilled in the art that the compensating assembly of the present invention could be mounted on the ram, rather than the bed, and the purpose of the present invention would be achieved. Reference is made to FIG. 19, a semi-diagrammatic representation of a conventional press brake, having the compensating assembly of the present invention applied to its ram. Again, the press brake comprises side frames 65 and 66, a bed 67, a ram 68 and main cylinders 69 and 70. The ram carries a male die 71 and the bed carries a female die 72.

A pair of cross-members (one of which is shown at 73) is mounted on the ram 68 by pins 74 and 75, in precisely the same manner described with respect to FIGS. 10–15. The cross-member 73 has an elongated slot 76, as will that cross-member not shown. The ram 68 has a corresponding slot, slightly offset in a vertical direction with respect to the slots of the cross-members. Within the slots, a cylinder-piston assembly 77 is mounted, in every way identical to cylinder-piston assembly 49 of FIGS. 10–12 and 15. The assembly 77 comprises cylinder 78 and piston 79. The cylinder 78 abuts the ram 68, while the piston 79 abuts the cross-members (one of which is shown at 73).

The assembly 77 is connected to the same hydraulic fluid source and pump system (not shown) as are main cylinders 69 and 70, and therefore sees the same pressure as main cylinders 69 and 70. Again, the assembly 77 has a working area equal to four times the working area of main cylinder 69 or main cylinder 70 (i.e., twice the working area of main cylinders 69 and 70, together).

When not under load, the tool or die-carrying edges 67*a* and 68*a* of bed 67 and ram 68 are normally parallel. When the ram descends and the male die 71 of ram 68 bends the workpiece into the female die 72 of bed 67, the ram and bed will be under load. In this instance, the bed will be deflected downwardly in the same manner described with respect to FIG. 2. However, through the agency of assembly 77, the resultant deflection of ram 68 will also be downwardly, with the bed edge 67*a* and the ram edge 68*a* remaining substantially parallel, to produce a workpiece having a substantially uniform bend angle throughout its length. Table III below gives the theoretical calculated bend angle variation for mild steel samples of various thicknesses and lengths when bent in a typical 135-ton by 10-foot long press brake of the type shown in FIG. 15 or FIG. 19, having a 10-foot nominal length bed.

TABLE III

| Mild Steel Thickness | Nominal V-Die Opening | Bend Angle Variation in Degrees for Given Workpiece Lengths | | | | |
|---|---|---|---|---|---|---|
| | | 2' | 4' | 6' | 8' | 10' |
| 20 Ga. | .312 | 0 | 0.1 | 0.2 | 0.4 | 0.8 |
| 18 Ga. | .375 | 0 | 0.1 | 0.2 | 0.4 | 0.8 |
| 16 Ga. | .500 | 0 | 0.1 | 0.2 | 0.4 | 0.8 |
| 14 Ga. | .625 | 0 | 0.1 | 0.2 | 0.4 | 0.8 |
| 12 Ga. | .875 | 0 | 0.1 | 0.2 | 0.4 | 0.8 |
| 11 Ga. | 1.000 | 0 | 0.1 | 0.2 | 0.4 | 0.8 |
| 10 Ga. | 1.250 | 0 | 0.1 | 0.1 | 0.3 | 0.6 |
| 3/16" | 1.500 | 0 | 0.1 | 0.2 | 0.4 | 0.8 |
| ¼" | 2.000 | 0 | 0.1 | 0.2 | 0.4 | — |
| 5/16" | 2.500 | 0 | 0.1 | 0.2 | — | — |
| ⅜" | 3.000 | 0 | 0.1 | — | — | — |
| 7/16" | 3.500 | 0 | 0.1 | — | — | — |
| ½" | 5.000 | 0 | 0 | — | — | — |

The variation values of Table III are due to bed and ram deflection only, and do not take into account variations resulting from repeatability, level errors, or from inaccuracies in the tooling.

Modifications may be made in the invention without departing from the spirit of it. For example, the orientation of cylinder-piston assembly 49 or cylinder-piston assembly 77 is not critical. Thus, in FIG. 15, the assembly 49 could be inverted so that cylinder 50 abuts the cross-members 19 and 20, and the piston 51 abuts bed 18. Similarly, the assembly 77 of FIG. 19 could be inverted so that cylinder 78 abuts the cross-members (one of which is shown at 73), and piston 79 abuts the ram 68.

In either embodiment described above, the male die could be mounted on the bed and the female die on the ram, without affecting the results. Furthermore, the concept of the present invention would also work on a press brake with an upwardly moving bed and a stationary ram.

In either of the embodiments above, if the bed and ram are very long, more than one compensating cylinder of different diameters could be used. It would also be within the scope of the present invention to provide a deflection compensating assembly (a compensating cylinder and a pair of cross-members) for both the bed and the ram. Under these circumstances, each of the compensating cylinders would have a working area twice that of one of the main cylinders.

The teachings of the present invention could also be applied to other hydraulically actuated fabricating machine tools where deflection is a problem, such as shears, bending rolls, presses and the like.

What is claimed is:

1. A deflection compensating assembly for use with a press brake of the type having a bed ram with opposed edges and cooperating dies mounted on said edges, and a pair of main hydraulic cylinders operatively connected to said ram to shift said ram away from said bed and toward said bed against a workpiece supported on said bed die, whereby said bed and ram are placed under load, resulting in opposite deflections of said bed and ram and non-parallelism of said die-supporting edges, said deflection compensating assembly comprising a hydraulic compensating cylinder having a piston and a pair of plate-like cross-members, said cross-members being located to each side of a selected one of said bed and ram extending longitudinally thereof for the majority of the length thereof, said cross-members being affixed at their ends to said selected one of said bed and ram by a pair of pins passing through coaxial perforations in said cross-members and said selected one of said bed and ram, said cross-members having elongated coextensive longitudinal slots formed therein, said selected one of said bed and ram having a corresponding elongaged longitudinal slot formed therein slightly offset vertically with respect to said cross-member slots, said slots being centered with respect to the vertical axis of said selected one of said bed and ram, said compensating cylinder being mounted within said slots, one of said compensating cylinder and its piston abutting said selected one of said bed and ram, the other of said compensating cylinder and its piston abutting said cross-members, said compensating cylinder and its piston having a working area twice that of said main cylinders combined, a source of hydraulic fluid under pressure, said compensating cylinder and said main cylinders each being connected to said source and each being subjected to the same pressure therefrom, whereby when said bed and ram are under load, said compensating cylinder is actuated to deflect said selected one of said bed and ram to bring its die-supporting edge into substantial parallelism with the die-supporting edge of the other of said bed and ram.

2. The structure claimed in claim 1, wherein said deflection compensating assembly is mounted on said bed.

3. The structure claimed in claim 1, wherein said deflection compensating assembly is mounted on said ram.

4. The structure claimed in claim 1, wherein said compensating cylinder has a center line of cylinder action, said center line of cylinder action and said axes of said pins being coplanar with the longitudinal center lines of said cross-members.

5. A deflection compensating assembly for use with a fabricationg machine tool of the type having a movable member and a fixed member with opposed cooperating surfaces, and a pair of main hydraulic cylinders operatively connected to said movable member to shift said movable member away from said fixed member and toward said fixed member against a workpiece, whereby said fixed and movable members are placed under load resulting in opposite deflections thereof and non-parallelism of said cooperating surfaces, said deflection compensating assembly comprising a hydraulic compensating cylinder having a piston and a pair of plate-like cross-members, said cross-members being located to each side of a selected one of said fixed and movable members extending longitudinally thereof for the majority of the length thereof, said cross-members being affixed at their ends to said selected one of said fixed and movable members by a pair of pins passing through co-axial perforations in said cross-members and said selected one of said fixed and movable members, said cross-members having elongated co-extensive longitudinal slots formed therein, said selected one of said fixed and movable members having a corresponding elongated longitudinal slot formed therein, slightly offset with respect to said cross-member slots, said slots being centered with respect to said selected one of said fixed and movable members, said compensating cylinder being mounted within said slots, one of said compensating cylinder and its piston abutting said selected one of said fixed and movable members, the other of said compensating cylinder and its piston abutting said cross-members, said compensating cylinder and its piston having a working area twice that of the main cylinders combined, a source of hydraulic fluid under pressure, said compensating cylinder and said main cylinders each being connected to said source and each being subjected to the same pressure therefrom, whereby when said fixed and movable members are under load, said compensating cylinder is actuated to deflect said selected one of said fixed and movable members to bring its cooperating surface into substantial parallelism with the cooperating surface of the other of said fixed and movable members.

* * * * *